US005106115A

United States Patent [19]

Wladar et al.

[11] Patent Number: 5,106,115

[45] Date of Patent: Apr. 21, 1992

[54] SOLE-SUPPORT DEVICE

[75] Inventors: Helmut Wladar, Vienna; Hubert Wuerthner, Hainburg; Karl Stritzl, Vienna; Roland Erdei, Weigelsdorf; Stefan Vomela, Vienna, all of Austria

[73] Assignee: TMC Corporation, Baar, Switzerland

[21] Appl. No.: 549,294

[22] Filed: Jul. 6, 1990

[30] Foreign Application Priority Data

Jul. 6, 1989 [AT] Austria ..... 1644/89
Jan. 18, 1990 [AT] Austria ..... 106/90

[51] Int. Cl.[5] ..... A63C 11/00
[52] U.S. Cl. ..... 280/636
[58] Field of Search ..... 280/636, 626, 628, 629

[56] References Cited

U.S. PATENT DOCUMENTS 3,448,990 6/1969 Cubberley et al. ..... 280/636
3,490,783 1/1970 Shimizu ..... 280/626

FOREIGN PATENT DOCUMENTS 2631842 12/1989 France ..... 280/636
89/10777 11/1989 World Int. Prop. O. ..... 280/636

*Primary Examiner*—Andres Kashnikow
*Assistant Examiner*—Eric Culbreth
*Attorney, Agent, or Firm*—Flynn, Thiel, Boutell & Tanis

[57] ABSTRACT

A sole-support device for ski bindings which includes a support member fastenable on a ski and an endless band guided transversely with respect to the longitudinal direction of the ski in a groove of the support member. In order to prevent in this device a relative movement between the upper strand of the band and the underside of the sole of the boot, the invention provides that the band, which is supported with its upper strand in the groove of the support member, has the shape of the jacket of a frustrum, and that the groove, in which the upper strand of the band is guided, has a circular extent arched toward the tip of the ski, viewed in a top view.

27 Claims, 8 Drawing Sheets

SOLE-SUPPORT DEVICE

FIELD OF THE INVENTION

The invention relates to a sole-support device.

BACKGROUND OF THE INVENTION

Such a device is already described in U.S. Pat. No. 3 845 965. This device has the disadvantage that its band is guided only in grooves on the two sides and on the underside of the support member, not, however, on the upper side. Thus lateral borders are missing (see FIGS. 2 and 5).

The device according to Austrian Patent No. 302 129 has the disadvantage that the band, which is thicker than the height of the lateral borders and in which support axes are supported, is pressed forwardly by the ski boot over the front edge when the skier steps with the ski boot into the binding and is thus deformed.

This is also the case in the device according to Austrian Patent No. 311 231, in which the position of the band in longitudinal direction of the ski is only defined by the bend in the support member.

The band has in all known sole-support devices the shape of the jacket of a cylinder. This has the result in practice that during a twisting fall of the skier, the movement of the upper strand of the band extends laterally along a straight line and thus deviates from the circular movement of the bearing area of the sole of the ski boot. This results in a relative movement of the upper strand of the band and of the underside of the sole of the ski boot and thus an undesired additional friction, which negatively influences the release of the ski boot.

The basic purpose of the invention is to overcome this disadvantage and to provide a sole-support device in which the movement of the upper strand of the band is approximately adapted to the pivoting movement of the ski boot.

This characteristic prevents during a twisting fall of the skier a relative movement between the upper strand of the band and the underside of the sole of the ski boot, since the upper strand of the band follows approximately the same radius as the pivoting movement of the ski boot.

This effect occurs in any desired ski boot. However, if the ski boot is dimensioned according to the dimensions determined in DIN 7880, then a locating of the centerpoint of the circular arc of the groove and band to coincide with the centerpoint of the circular arc formed by the rear sole edge of the sole of the boot will be beneficial.

A construction incorporating a torsion spring for tensioning the band is slightly more complicated in its design, however, it has the advantage that the tension of the band and the pressure transmission are caused by separate elements. The elements can in this manner be dimensioned corresponding with the respective tasks.

BRIEF DESCRIPTION OF THE DRAWINGS

Exemplary embodiments of the subject matter of the invention are illustrated in the drawings, in which.

DETAILED DESCRIPTION

Figure 1:
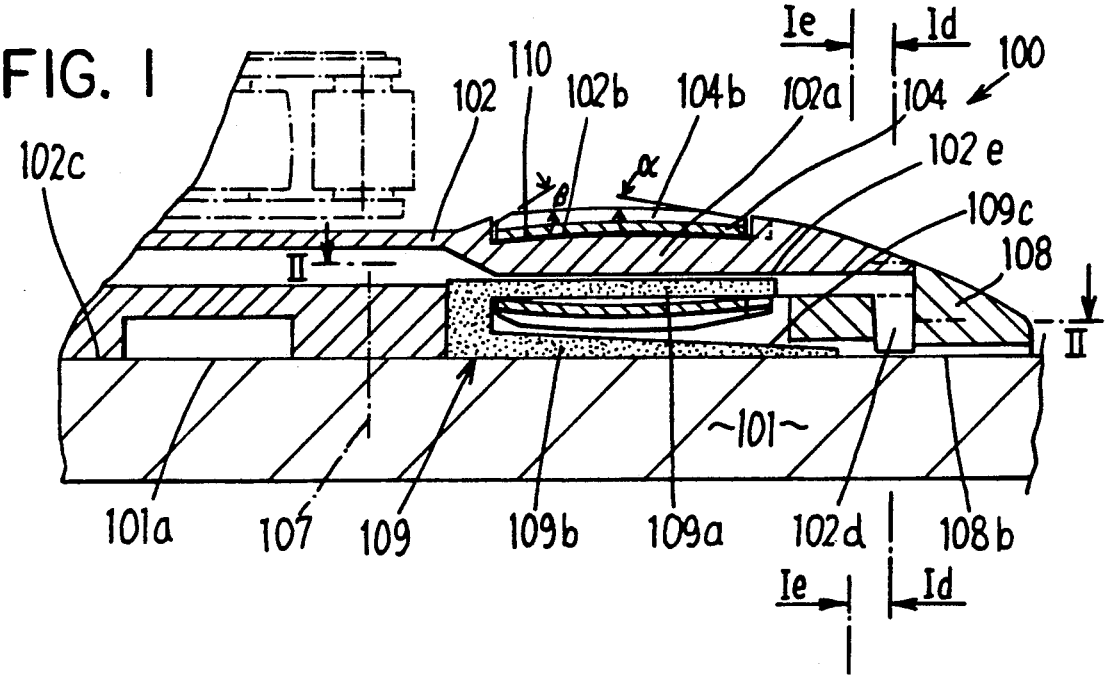
FIG. 1 is a vertical longitudinal central cross-sectional view of a first embodiment.
Figure 1A:
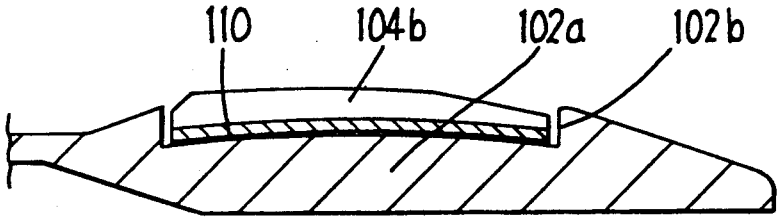
FIGS. 1*a* and 1*b* show in an enlarged scale details of the first embodiment.
Figure 2:
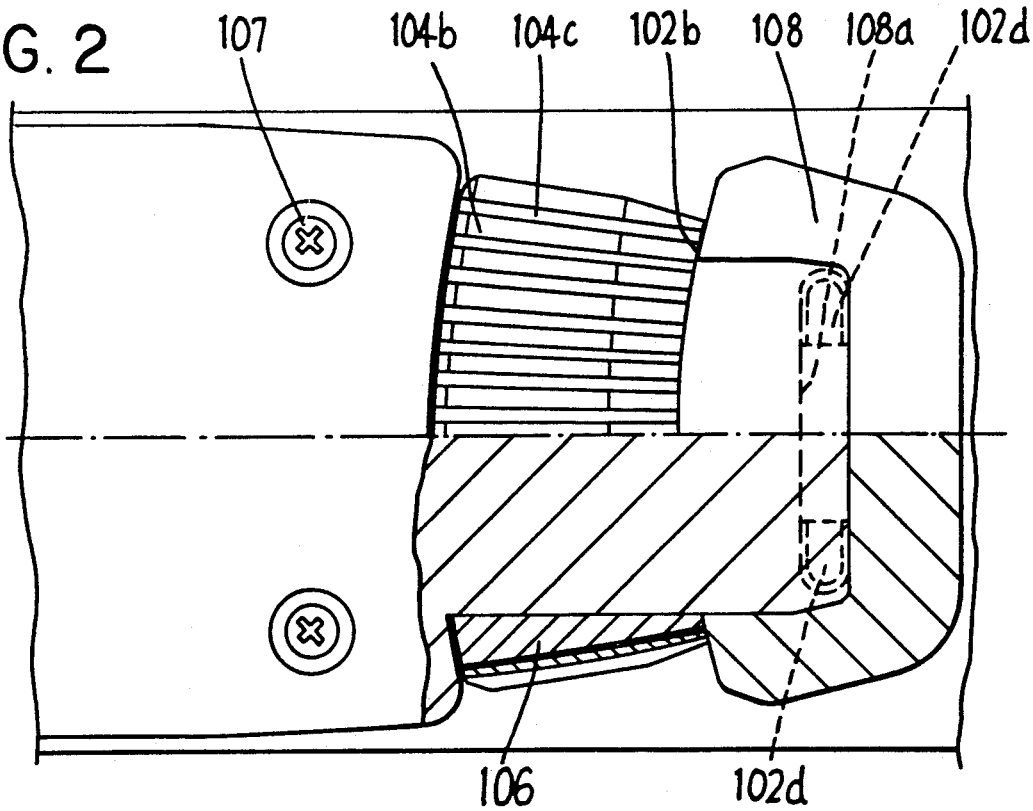
FIG. 2 is a top view of FIG. 1, partly in cross section, taken along the line II—II of FIG. 1.

The sole support device illustrated in FIGS. 1 and 2 is identified in its entirety by the reference numeral 100. It has a support member 102 which can be fastened to the upper side 101*a* of a ski 101. An endless band 104 is supported in a groove 102*b* in the center support section 102*a* of the support member 102, which support section is hereinafter also referred to as section. The groove 102*b*—viewed in the top view of the device 100—is curved according to a circular arc with the radius R (see FIG. 1*c*), the centerpoint P of which coincides with the centerpoint of the circular arc with the radius $R_1$ formed by the rear sole edge of the sole of the boot, assuming that the sole of the ski boot corresponds with the Norm DIN 7880.

The band 104, which is manufactured of rubber with a Shore A hardness of 50–85, has the shape of the jacket of a frustrum opening toward the tip of the ski and has ribs 104*b* on its upper side, between which ribs grooves 104*c* exist. On the edge facing the tail of the ski there are ribs 104*b*, the upper surfaces of which are inclined at an angle $\alpha$ between 2° and 15° relative to the upper side. Whereas on the opposite edge facing the tip of the ski, the upper surfaces of the ribs form the angle $\beta$ which lies between 10° and 45° relative to the upper side. The slopes of the ribs 104*b* form thereby edges in their free edge areas with the individual faces of the band 104, which faces extend below the upper boundary edges of the associated sidewall of the groove 102*b* or are aligned with these boundary edges. It is thus prevented that when the skier steps in with his ski boot or during a forward twisting fall of the skier the band 104 is pulled out of the groove 102*b*.

Figure 1B:
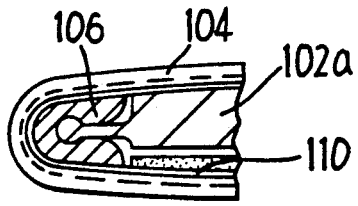

In the area of the guide points, namely, at the lateral edges of the support member 102 of the band 104, there are arranged two generally wedge-shaped members 106 of rubber or plastic extending in longitudinal direction of the ski, for example by means of a dovetail guide, between the band 104 and the support section 102*a* (compare FIG. 1*b*). The band 104 is tensioned with respect to the support section 102*a* by the members 106.

A strip 110 of a material with good sliding characteristics, for example of polytetrafluoroethylene (Teflon), can be arranged between the support section 102*a* of the support member 102 and the band 104, which strip also encloses the generally wedge-shaped members 106 and which strip eases the sliding of the band 104.

The support member 102 has in the area in front of the support section 102*a* a flat bearing surface 102*c* which is fastened by means of screws 107 indicated in FIGS. 1 and 2 to the upper side 101*a* of the ski 101. The support member 102 is in the area behind the support section 102*a* provided with downwardly directed projections 102*d*. The projections 102*d* are inserted into a slotted hole 108*a* of an end part 108 which has also a flat bearing surface 108*b*.

A downwardly and rearwardly open groove 102*e* is recessed below the support section 102*a* of the support member 102 into the support member. The upper leg 109*a* of an insert member 109 U-shaped in cross section and consisting of a hydrophobic and elastic material, for example of silicone rubber or polyethylene, is inserted into the groove 102*e*. Alternatively, it is possible to use members of a closed-porous rubber sponge with a glued-on foil of polytetrafluoroethylene (Teflon).

The lower leg 109*b* of the insert member 109 is arranged below the lower strand of the band 104 on the upper side 101*a* of the ski between the support member 102 and the end part 108. The upper side 109*c* of the leg 109*b* is for example formed by a conical surface or by two adjacent surfaces of a pyramid. If ice crystals form during the transport or during skiing between the lower strand of the band 104 and the insert member 109, these are broken up by the skier due to the fact that the weight of the skier bends the support section 102*a* downwardly. In the case of a twisting fall of the skier, the ice particles are removed by means of the lower strand of the band 104 through the narrow sides of the ski 101.

Figure 3:
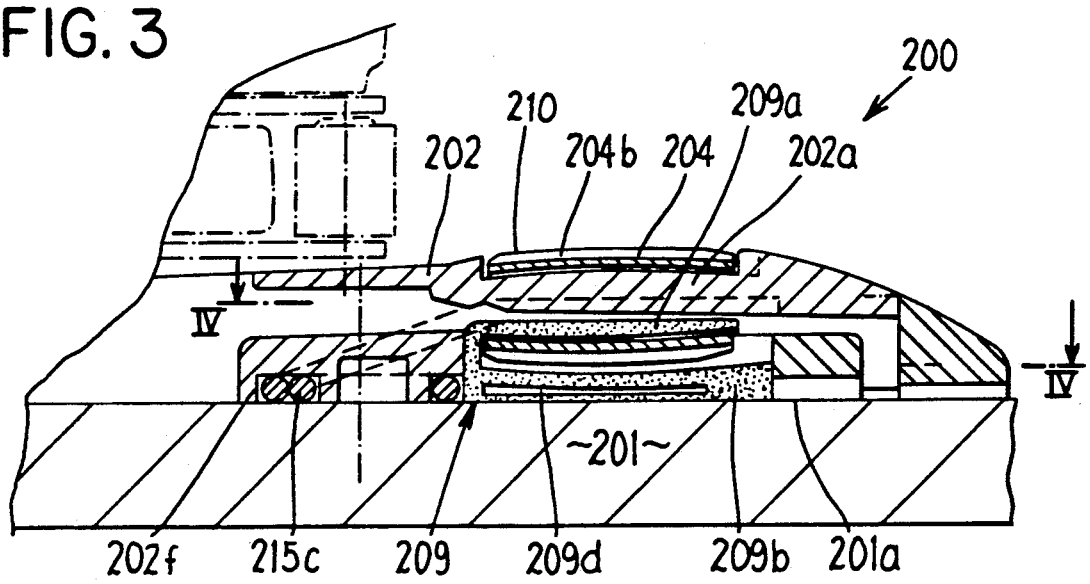
FIGS. 3 and 4 are a vertical longitudinal central cross-sectional view and a top view, respectively, of a second embodiment, the top view being partly cut along the line IV—IV of FIG. 3.
Figure 4:
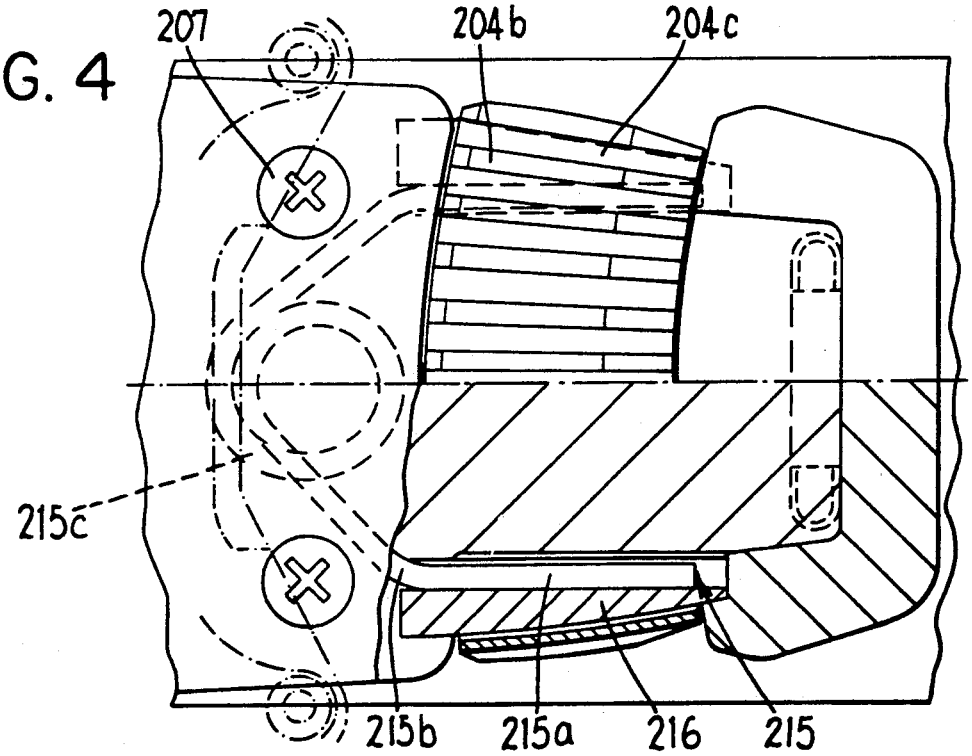

The embodiment of a sole-support device 200 illustrated in FIGS. 3 and 4 is similar to the one first described including the strip 210. The second embodiment differs from the first embodiment in that the band 204 is held under tension by the legs 215*a* of a U-shaped torsion spring 215. Pressure elements 216 preferably U-shaped in cross section are mounted on the legs 215*a* of the spring 215, which pressure elements assure an even pressure distribution. The pressure elements 216 are tapered generally wedge-shaped toward the end of the ski. The bight portion 215*b* of the torsion spring 215 includes a loop 215*c* and is housed in a recess 202*f* of the support member 202, which recess is open toward the upper side 201*a* of the ski. The bight portion 215*b* of the torsion spring 215 is in this manner held nonmovably with respect to the ski 201.

A further difference between this device 200 and the first one described above is that the insert member 209 of plastic, which insert member lies under the support section 202*a* of the support member 202 and is approximately U-shaped in cross section, rests with its lower leg 209*b* on the upper side 201*a* of the ski forming a closed cavity 209*d*. The elasticity of the lower leg 209*b* of the insert member 209 is increased with this cavity 209*d*. Thus, this insert member 209 also enhances the breaking up of the ice crystals possible forming in the space between the lower strand of the band 204 and the leg 209*b*, which ice crystals are moved out of the device just like in the first embodiment by the transverse movement of the band 204 with the help of the ribs 204*b*.

Figure 5:
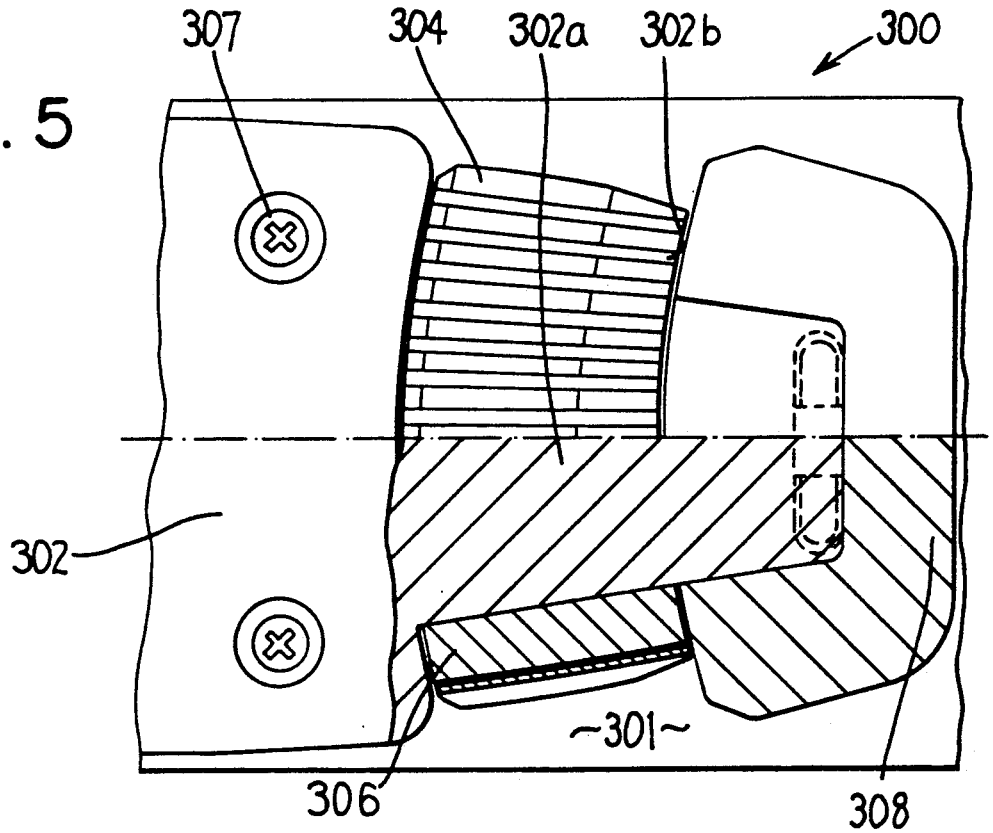
FIG. 5 is a partially cross-sectional top view of a third embodiment.

The sole-support device 300 according to FIG. 5 is distinguished by the support section 302*a* being trapezoidal in the top view. Thus, the two members 306 of rubber or plastic, which are in the area of the guide points of the band 304, can be constructed with a constant cross section, which significantly simplifies their manufacture. The remaining design of the device 300 corresponds with the one shown in FIGS. 1 and 2, wherein the groove 302*b* is curved like the groove 102*b* and the support member 302 is fastened to the upper surface of the ski by screws 307 just as in the case of the screws 107.

Figure 6:
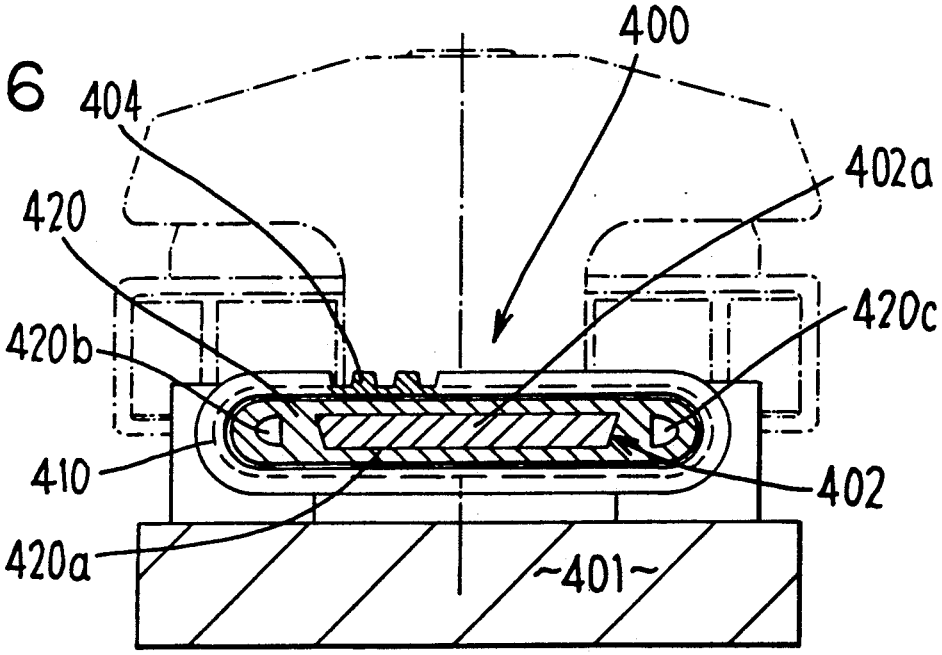
FIG. 6 is a cross-sectional view of a fourth embodiment.
Figure 6A:
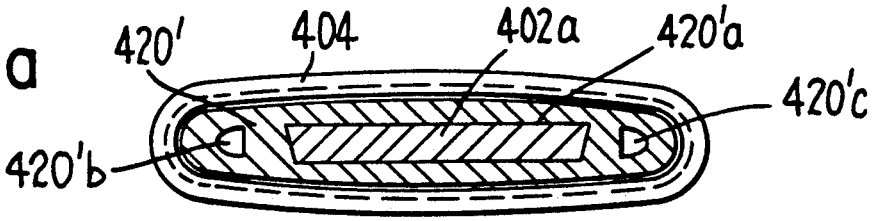
FIG. 6*a* is a modification of the embodiment illustrated in FIG. 6.

The modifications of a sole-support device 400 illustrated in FIGS. 6 and 6*a* are distinguished by one single bearing member 420 or 420' of rubber or plastic, which bearing member is trapezoidal in the top view and supports the band 404 and also the strip 410 over its entire circumference, being moved onto the support section 402*a*. To enable a mounting of the bearing member 420, 420' on the support section 402*a*, the bearing member 420, 420' has a central recess 420*a*, 420'*a* which extends over the entire width, thus is continuous. Two circumferentially closed recesses 420*b*, 420'*b* and 420*c* and 420'*c* are additionally constructed in the areas of the guide points of the band 404, which recesses increase the elasticity of the member 420, 420' in these areas. The recesses 420*b*, 420'*b* and 420*c*, 420'*c* enable also an absorption of the material displaced by the tensioned band 404.

Otherwise the bearing members 420 and 420' according to FIGS. 6 and 6*a* are similar to one another. They differ only in the bearing member 420 according to FIG. 6, viewed in the cross section, having a rectangular shape with semicircularly rounded narrow sides, whereas the bearing member 420' according to FIG. 6*a* has an approximately elliptic cross section.

The fifth sole-support device illustrated in FIGS. 7 to 11 is identified in its entirety by the reference numeral 500. It has a support member 502 fastenable to the upper side 501*a* of a ski 501, in the center support section 502*a* of which support member 502, which support section is hereinafter also identified as section, there is supported a continuous cylindrical band 504 in a groove 502*b*.

Figure 1C:
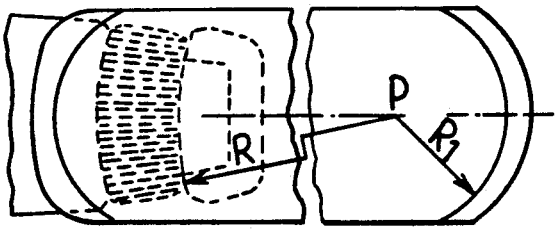
FIG. 1*c* is a schematic top view of the ski boot with the sole-support device.
Figure 1D:
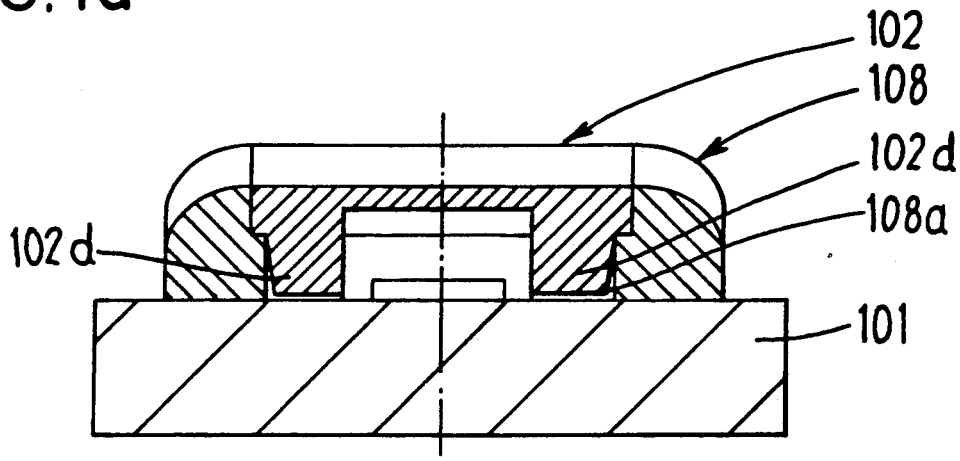
FIG. 1*d* is a cross-sectional view taken along the line Id—Id of FIG. 1.
Figure 1E:
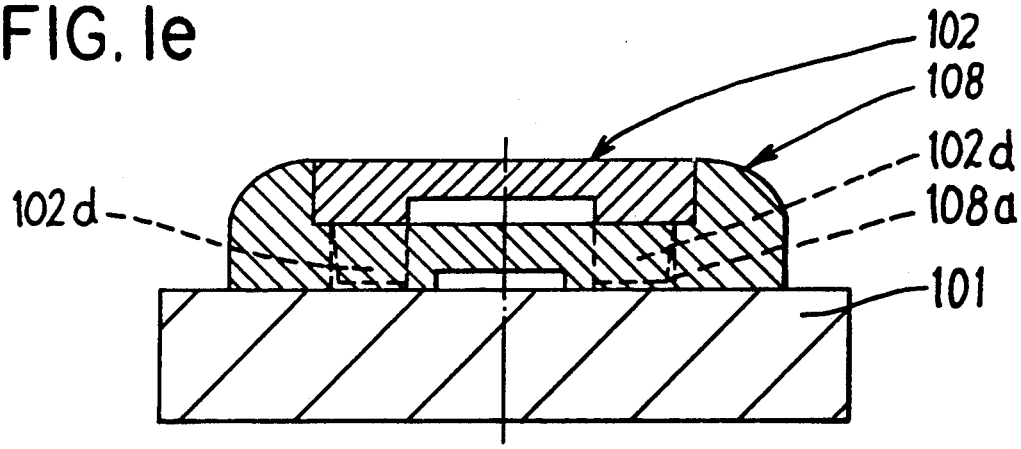
FIG. 1*e* is a cross-sectional view taken along the line Ie—Ie of FIG. 1.
Figure 1F:
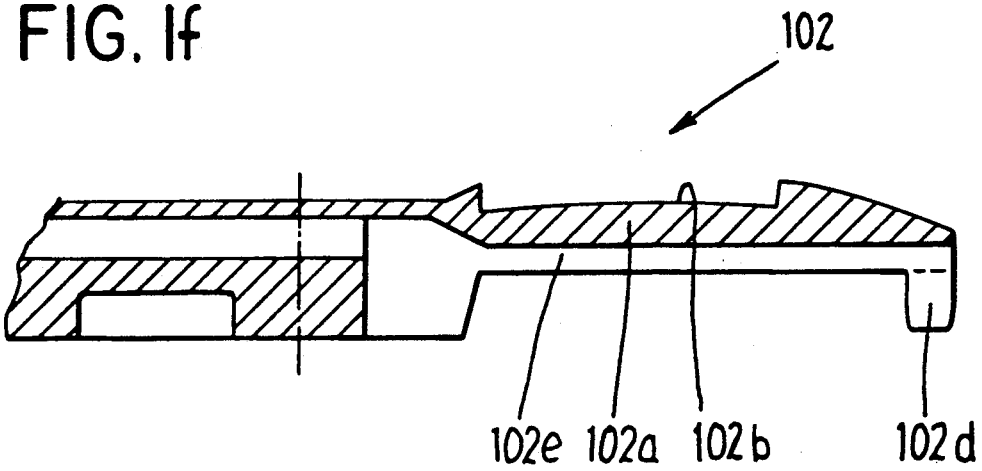
FIG. 1*f* shows a detail of the first embodiment.
Figure 1G:
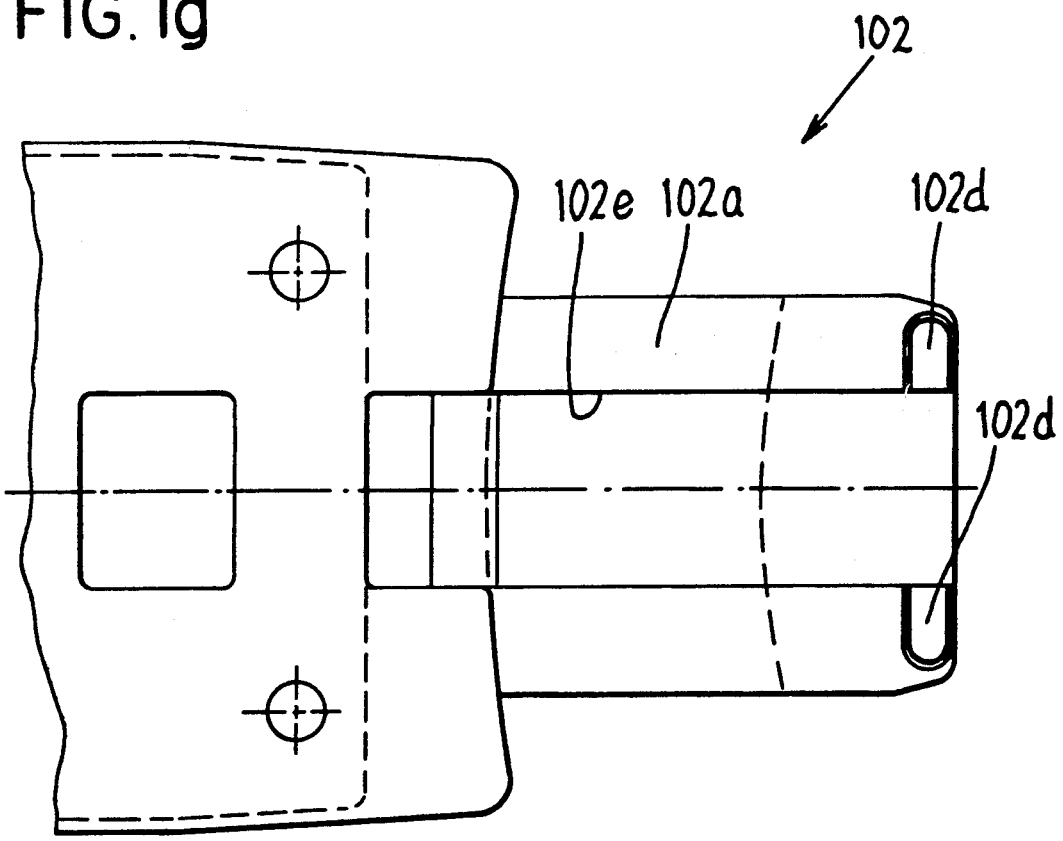
FIG. 1*g* is a bottom view of FIG. 1*f*.

This groove 502*b* is—viewed in the top view of the device 500—curved according to a circular arc having a radius R, the centerpoint of which coincides with the centerpoint of the circular arc formed by the rear sole edge of the sole of the boot, assuming that the sole of the ski boot corresponds with the Norm DIN 7880 (compare FIG. 1*c*).

The band 504 manufactured of rubber with a Shore A hardness of 50–85 has the shape of the jacket of a frustrum, which opens toward the tip of the ski, and has ribs 504*b* on its upper side, the upper surface of which ribs are sloped at an angle $\alpha$ between 2° and 15° at the edge facing the tail of the ski. Whereas on the opposite edge facing the tip of the ski the upper surface of the ribs form an angle $\beta$ which lies between 10° and 45°. A strip 510 of polytetrafluoroethylene exists between the band 504 and the support section 502*a*. Reference numeral 519 identifies the front jaw shown here in dash-dotted lines.

Figure 7:
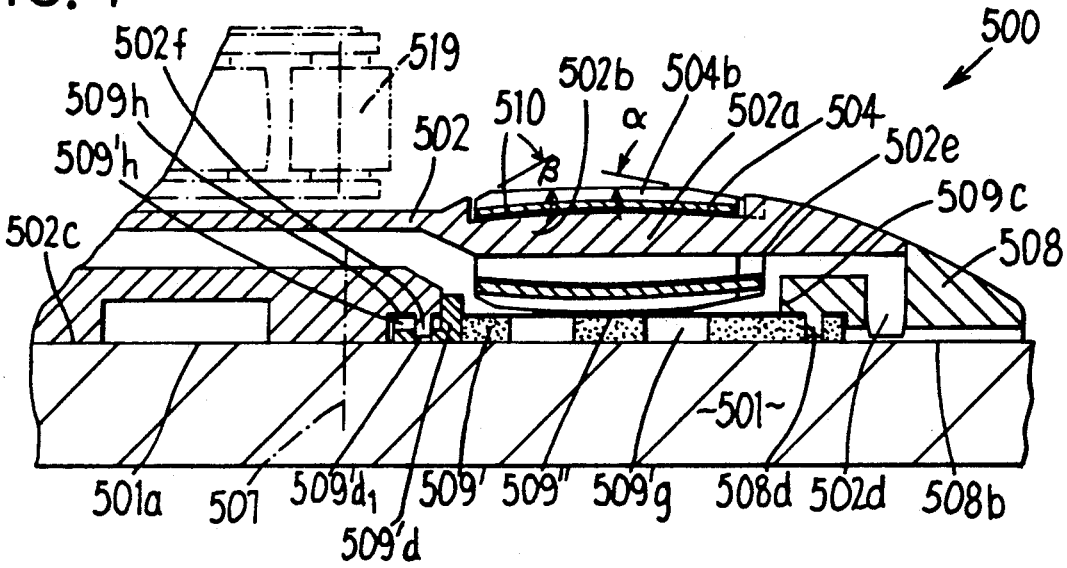
FIG. 7 is a vertical longitudinal central cross-sectional view of a fifth embodiment.
Figure 8:
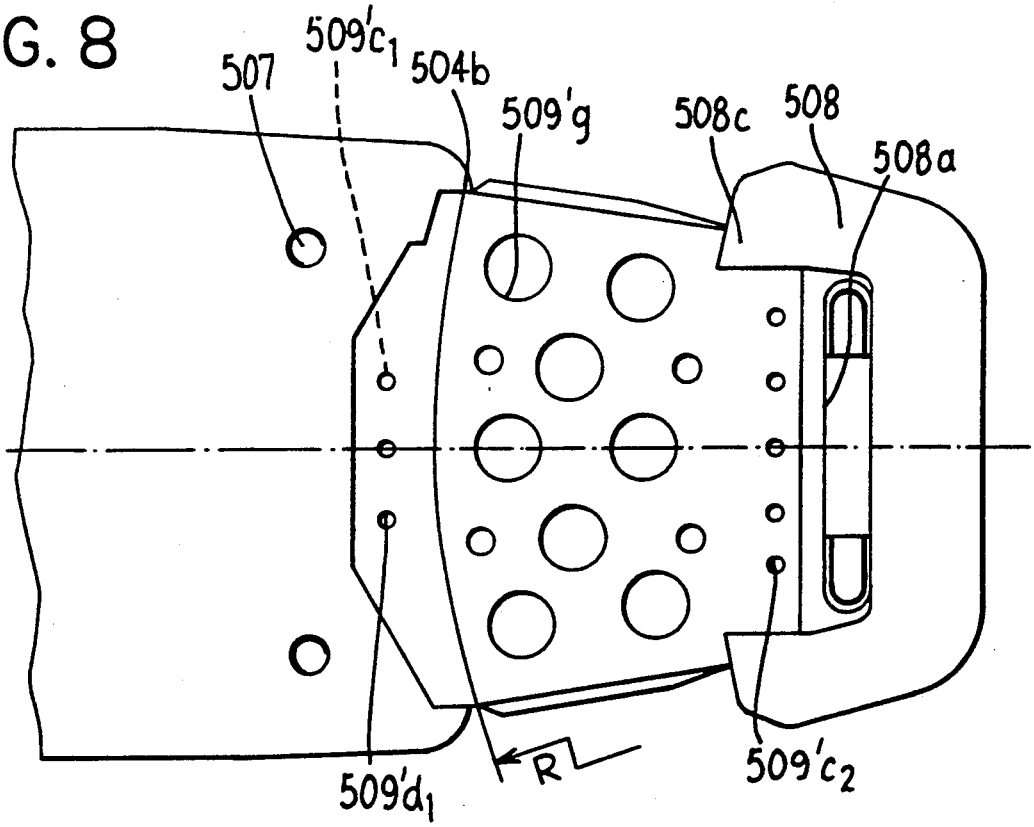
FIG. 8 is a bottom view of FIG. 7.
Figure 9:
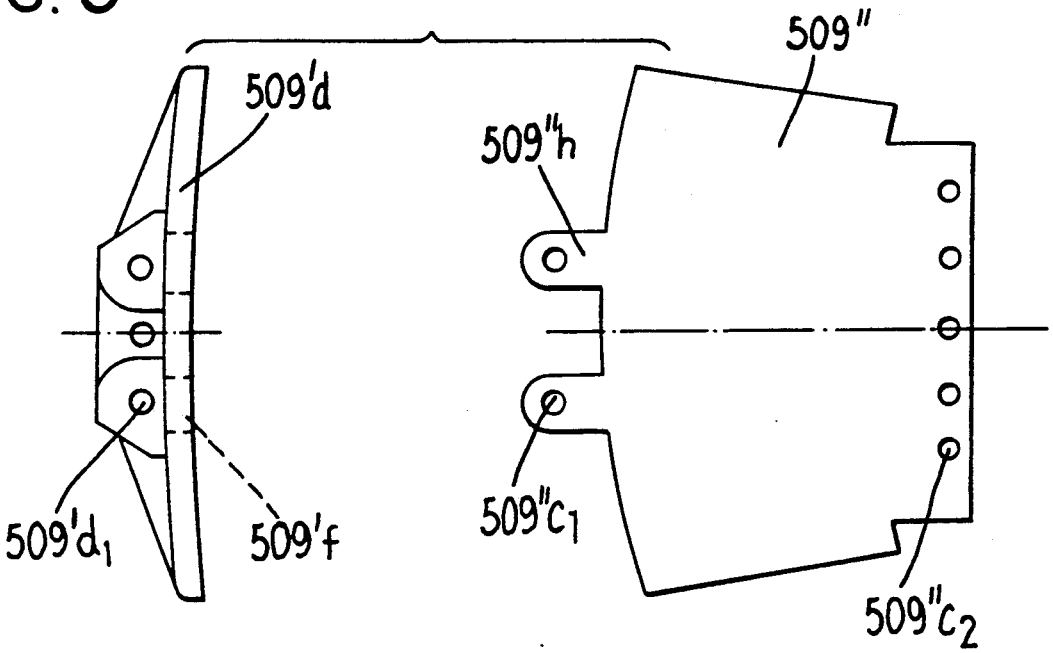
FIG. 9 illustrates the plate and the holder in a pulled-apart state.
Figure 10:
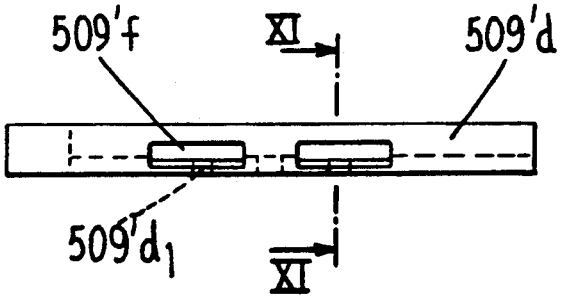
FIG. 10 shows a view of the holder in direction of the arrow X of FIG. 11.
Figure 11:
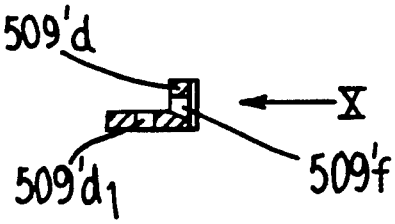
FIG. 11 is a cross-sectional view taken along the line XI—XI of FIG. 10.

The support member 502 has in the area in front of the support section 502*a* a flat bearing surface 502*c* which is secured on the upper side 501*a* of the ski 501 by means of screws 507, which are only indicated in FIG. 7. The support member 502 has projections 502*d* in the area behind the support section 502*a*. The projections 502*d* are inserted in a slotted hole 508*a* of an end part 508 also provided with a flat bearing surface 508*b*. The end part 508 furthermore has extensions 508*c* laterally gripping around the support section 502*a*.

A recess 502*e* which opens downwardly and toward both sides exists below the support section 502*a* of the support member 502 in the support member. The recess is closed off by a plate 509' covered with a foil 509'' of polytetrafluoroethylene. The plate 509' in the illustrated exemplary embodiment consists of an elastic material with a hardness of up to a maximum 30 Shore A. It has recesses 509'*g* for increasing the flexibility of the plate 509'. However, the possibility also exists to limit the hardness of the plate to a maximum 15 Shore A. The flexibility of the plate 509' is so great in this case that recesses are not needed.

The plate 509' and the foil 509'' have holes 509'$c_1$, 509'$c_2$, 509''$c_1$, 509''$c_2$ at their two edges, with which holes they can be mounted on downwardly extending pegs 502*f* of the support member 502 or on downwardly extending pegs 508*d* of the end part 508 and to which pegs the plate 509' and the foil 509'' can be secured. The plate 509' and the foil 509'' are held at one edge by means of fishplates 509'*h*, 509''*h* having the holes 509'$c_1$ or 509''$c_1$ in received slots 509'*f* provided in a holder 509'*d*, which slots are rectangular in cross section. The horizontal leg of the holder has also a number of holes 509'$d_1$. The two slots 509'*f* are arranged symmetrically with respect to the vertical longitudinal center plane of the device 500 (compare the detail in FIGS. 9 to 11).

The foil 509'' and the plate 509' make it possible in a simple manner to remove those ice crystals which form during skiing between the lower strand of the band 504 and the foil 509'', from the device during a fall of the skier.

Figure 12:
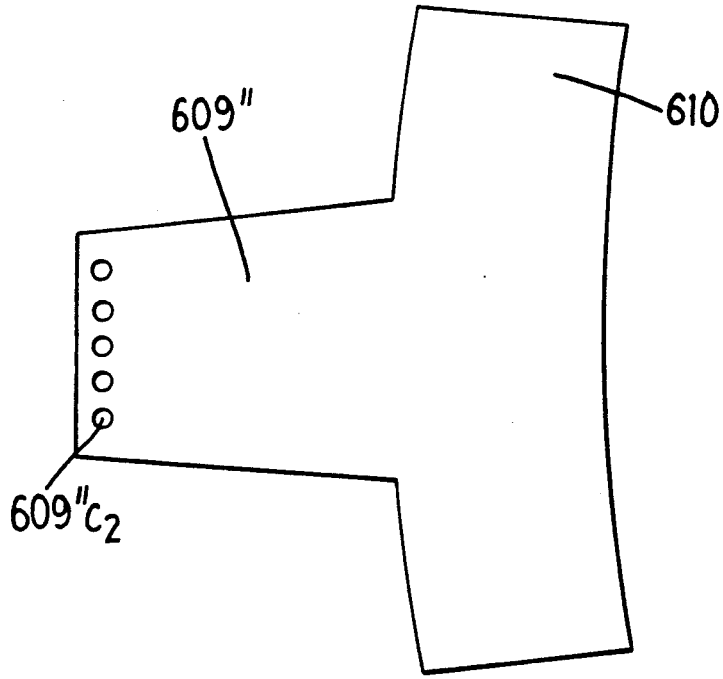
FIG. 12 is a top view of a sixth embodiment, namely, of a blank of a piece consisting of a foil and strip prior to the ends of the strip being welded together.
Figure 13:
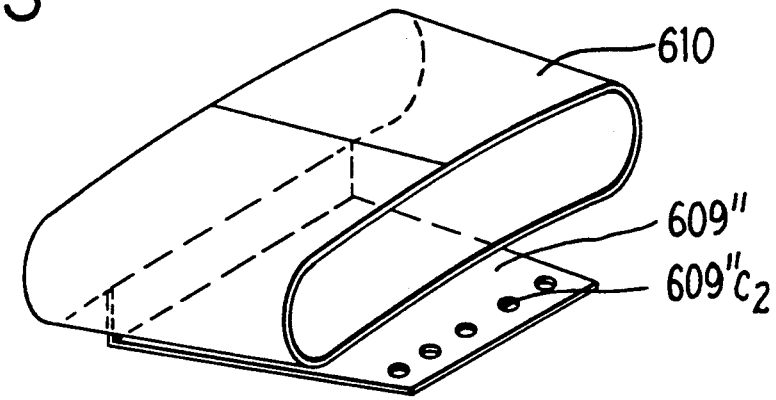
FIG. 13 is a three-dimensional view of the same piece, however, after the two ends of the strip have been welded together.
Figure 14:
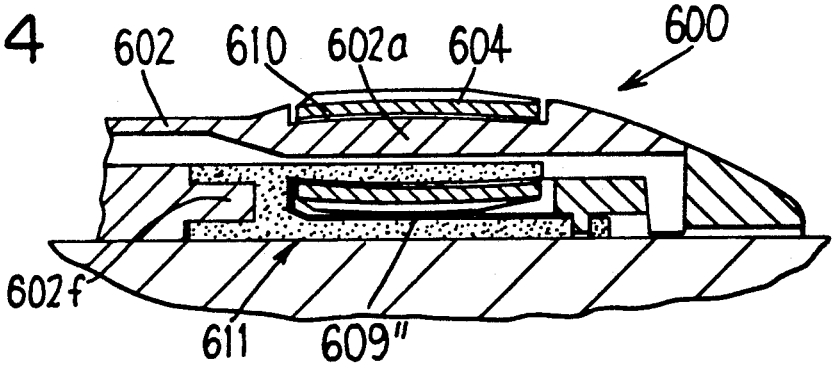
FIG. 14 is a vertical longitudinal central cross-sectional view of the piece in the state in which it is built into the sole-support device 600.

The sixth embodiment 600 illustrated in FIGS. 12 to 14, of which only a detail is shown, is distinguished by the strip 610 of polytetrafluoroethylene arranged between the band 604 and the support section 602*a* of the support member 602, together with the foil 609'' being manufactured of one piece, which as a blank has in the top view approximately the shape of a "T". First, the two ends of the strip 610 are welded together in the case of this piece. The stem of the "T", which has a number of holes 609''$c_2$ across the width of its free end, is thereafter bent at 180° so that the free end of the stem extends parallel with respect those sections of the strip 610 which form the bearing areas for the two strands of the band 604.

The piece consisting of the foil 609'' and of the strip 610 is thereafter injection molded to an elastic material, for example foam rubber, natural rubber or the like, forming a base member 611. The base member 611 has—viewed in a longitudinal cross section—an approximately H-shaped design. The base member 611 is thereafter moved with its two frontwardly extending legs onto an extension 602*f* of the support member 602.

Figure 15:
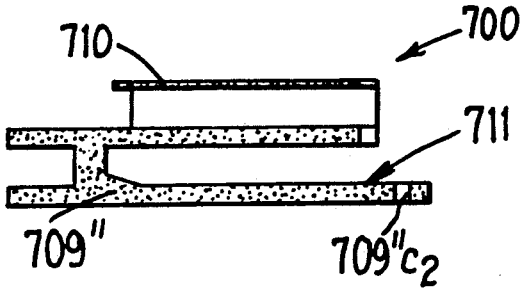
FIG. 15 is also a vertical longitudinal central cross-sectional view of a detail of a seventh embodiment of the device of the invention.

The seventh embodiment 700 illustrated in FIG. 15 is distinguished by the piece consisting of the foil 709'' and of the strip 710 together with the base member 711 forming one single structural part. The base member 711 is thereby also formed of an elastic material, for example of polytetrafluoroethylene. This one-piece construction of the parts 709'' , 710 and 711 simplifies the assembly of the device.

The invention is not to be limited to the exemplary embodiments illustrated in the drawings and described above. Rather various modifications of the same are possible without departing from the scope of the invention. For example, it would be conceivable to arrange disk-shaped rollers at least on one side of the groove, which rollers are mounted for movement along a circular arc and further reduce the friction of the band.

FIG. 1*b* illustrates a dovetail guide in the member 106 in which the projection from the support section 102*a* is received. However, it is also easily conceivable to construct the groove in the support section and the projection on the member. Furthermore, it is possible to provide the structural parts provided at the guide points of the band, instead of with the strip of polytetrafluoroethylene (Teflon), also with a suitable coating of a material having good sliding characteristics.

Furthermore it would be possible in the last exemplary embodiment to fasten the member, which consists of the strip and the foil and which is H-shaped in longitudinal cross section, instead of to an extension of the support member, to an extension of the end part.

Furthermore, it is possible in the fifth exemplary embodiment to glue the foil to the plate, or it is possible to apply during a separate manufacturing operation a layer of a low friction material onto the plate.

The embodiments of the invention in which an exclusive property or privilege is claimed are defined as follows:

1. A sole-support device for ski bindings, comprising:
a support member adapted to be fastened to a ski;
a groove on said support member;
a continuous band guided transversely with respect to a longitudinal direction of the ski in said groove on said support member, said band having upper and lower strands and several ribs, said upper strand being oriented in said groove on said support member, a front facing surface of said band and a rear facing surface of said band each defining an edge, said ribs being sloped adjacent said edges, said edges being at one of lying below an upper boundary edge of a front and a rear sidewall of said groove and aligned with said front and said rear sidewall, said upper strand of said band has, viewed in a top view, a circular extent arched toward a tip of said ski.

2. The device according to claim 1, wherein said support member is positioned adjacent a front jaw of said ski binding, and wherein a centerpoint of a circular arc of said curved groove coincides with a centerpoint of a circular arc formed by a rearwardly facing sole edge of a sole of said boot.

3. The device according to claim 1, wherein two wedge-shaped members are fastened to said support member and define guide points for said band.

4. The device according to claim 3, wherein said wedge-shaped members are held on said support member by means of a dovetail guide.

5. The device according to claim 3, wherein said wedge-shaped members are made of at least one of rubber and plastic.

6. The device according to claim 1, wherein for tensioning said band a torsion spring having a pair of legs is arranged in said support member, said legs of said torsion spring having pressure elements fastened thereto, said pressure elements being made of a material having good sliding characteristics, said pressure elements being arranged at guide points for said band.

7. The device according to claim 1, wherein said support member includes a support section which is trapezoidal in shape, viewed in a top view, which support section carries elongated members on both longitudinal sides, the cross section of which members is constant over their entire length.

8. The device according to claim 7, wherein said members are held on said support section by means of a dovetail guide.

9. The device according to claim 7, wherein a bearing member consisting of a rubber-elastic material and being trapezoidal-shaped, in a top view, is supported on said support section, which bearing member—viewed in a cross section—has at least one of an elliptical and a rectangular shape with semicircularly rounded narrow sides.

10. The device according to claim 9, wherein recesses closed over their circumference are provided in said bearing member in a region of said guide points for said band.

11. The device according to claim 7, wherein a strip of polytetrafluoroethylene is arranged on an upper side of at least one of said support section and said bearing member.

12. The device according to claim 1, wherein said support member includes a support section oriented beneath a location for a ski boot, wherein below said support section there is a downwardly and rearwardly open groove, into which groove is received an upper leg of an insert member made of hydrophobic and elastic material, said insert member being U-shaped in cross section.

13. The device according to claim 12, wherein said insert member is made of at least one of silicone rubber and polyethylene.

14. The device according to claim 1, wherein said support member includes a support section oriented beneath a location for a ski boot, wherein below said support section there is provided a recess opening downwardly and laterally, in which recess is guided said lower strand of said band, said recess being closed off by a foil of a material having good sliding characteristics.

15. The device according to claim 14, wherein said foil is arranged on a base of an elastic material, which base is adapted to be supported on said ski beneath said support section.

16. The device according to claim 15, wherein said base is manufactured of a material having a Shore A hardness up to a maximum of 15.

17. The device according to claim 15, wherein said base is manufactured of a material having a Shore A hardness up to a maximum of 30 and has plural recesses therein.

18. The device according to claim 14, wherein said base and said foil have holes adjacent a front end and a rear end thereof, in which holes is received pegs on at least said support member.

19. The device according to claim 18, wherein a holder angular in cross section is provided, and wherein both said base and also said foil are provided each with two tabs, each of said tabs having a hole therethrough and being adapted to be guided into slots provided in said holder.

20. The device according to claim 18, wherein said holes adjacent said front end receive pegs on said support member and said holes adjacent said rear end receive pegs on an end part mounted on said ski.

21. The device according to claim 16, wherein said foil together with a strip on which said band is supported, is manufactured in one piece, said piece having as a blank a shape of a "T" in a top view.

22. The device according to claim 21, wherein opposite ends of said strip are welded together.

23. The device according to claim 22, wherein said piece is injected molded all around with an elastic material to form a base member.

24. The device according to claim 23, wherein said base member—viewed in a longitudinal cross section—has a shape of an "H" having two frontwardly extending legs which extend onto an extension of said support member.

25. The device according to claim 23, wherein said elastic material is one of foam rubber and natural rubber.

26. The device according to claim 21, wherein said piece has integrally formed thereon a base member which has, viewed in a longitudinal cross section, a shape of an H.

27. The device according to claim 14, wherein said material of said foil is polytetrafluoroethylene.

* * * * *

UNITED STATES PATENT AND TRADEMARK OFFICE

CERTIFICATE OF CORRECTION

PATENT NO. : 5 106 115

DATED : April 21, 1992

INVENTOR(S) : Helmut Wladar et al.

It is certified that error appears in the above-identified patent and that said Letters Patent is hereby corrected as shown below:

Column 6, Line 65; change "said boot" to ---a ski boot---.

Column 8, Line 30; change "16" to ---14---.

Signed and Sealed this

Twelfth Day of October, 1993

Bruce Lehman

*Attest:*

BRUCE LEHMAN

*Attesting Officer*

*Commissioner of Patents and Trademarks*